US012767413B2

(12) United States Patent
Kitamoto et al.

(10) Patent No.: US 12,767,413 B2
(45) Date of Patent: Oct. 20, 2026

(54) PACKAGING SUPPORTER

(71) Applicant: KYOCERA CORPORATION, Kyoto (JP)

(72) Inventors: Yu Kitamoto, Moriyama (JP); Ryo Kizuka, Higashiomi (JP)

(73) Assignee: KYOCERA CORPORATION, Kyoto (JP)

( * ) Notice: Subject to any disclaimer, the term of this patent is extended or adjusted under 35 U.S.C. 154(b) by 22 days.

(21) Appl. No.: 18/846,272

(22) PCT Filed: Mar. 3, 2023

(86) PCT No.: PCT/JP2023/008108
§ 371 (c)(1),
(2) Date: Sep. 12, 2024

(87) PCT Pub. No.: WO2023/181858
PCT Pub. Date: Sep. 28, 2023

(65) Prior Publication Data

US 2025/0187809 A1 Jun. 12, 2025

(30) Foreign Application Priority Data

Mar. 23, 2022 (JP) ..... 2022-047346

(51) Int. Cl.
*B65D 81/05* (2006.01)

(52) U.S. Cl.
CPC ..... *B65D 81/05* (2013.01)

(58) Field of Classification Search
CPC .... B65D 5/5035; B65D 5/5028; B65D 81/05; B65D 77/042; B65D 81/07
USPC ..... 206/521, 485, 583
See application file for complete search history.

(56) References Cited

U.S. PATENT DOCUMENTS 1,900,820 A * 3/1933 Kenyon ..... B65D 5/5035 206/576
2,609,136 A * 9/1952 Sider ..... B65D 5/505 206/521
2,744,622 A * 5/1956 Sparks ..... B65D 5/4204 206/521.2
2,827,219 A * 3/1958 Sparks ..... B65D 5/5061 206/592
2,846,064 A * 8/1958 Rowe ..... B65D 5/5035 206/322
2,941,709 A * 6/1960 Plevyak ..... B65D 5/5035 206/586

(Continued)

FOREIGN PATENT DOCUMENTS

JP H06-293362 A 10/1994
JP H09-104476 A 4/1997

*Primary Examiner* — Prince Pal
(74) *Attorney, Agent, or Firm* — HAUPTMAN HAM, LLP

(57) ABSTRACT

A packaging supporter includes a support that is a rectangular prism. The support supports a photosensitive drum that is an item to be packaged in a box. The support includes first to seventh walls, and first and second reinforcements. The first reinforcement is continuous with the first wall and protrudes from the first wall toward the third wall. The first reinforcement is supported by a first recessed corner. The second reinforcement is continuous with the seventh wall and protrudes from the seventh wall toward the fifth wall. The second reinforcement is supported by a second recessed corner.

8 Claims, 10 Drawing Sheets

(56) References Cited

U.S. PATENT DOCUMENTS 3,465,877 A * 9/1969 Martin ..... B65D 5/5035 206/433
4,027,794 A * 6/1977 Olson ..... B65D 5/5095 206/583
4,134,497 A * 1/1979 Dlugopolski ..... B65D 5/5038 206/521
4,792,043 A * 12/1988 Holladay ..... B65D 85/68 206/349
5,056,665 A * 10/1991 Boecker ..... B65D 81/07 206/583
5,226,542 A * 7/1993 Boecker ..... B65D 81/07 206/583
5,263,612 A * 11/1993 Nederveld ..... B65D 5/008 229/113
5,341,934 A * 8/1994 Hsu ..... B65D 81/05 206/521
5,782,354 A * 7/1998 Genix ..... B65D 5/5069 206/521
5,894,932 A * 4/1999 Harding ..... B65D 81/075 206/583
5,988,389 A * 11/1999 Buscema ..... B65D 5/5035 229/120.37
6,685,025 B1 * 2/2004 Kari ..... B65D 5/5069 206/583
7,278,249 B2 * 10/2007 Kari ..... B65D 5/5069 493/137
8,230,997 B1 * 7/2012 McWilliams ..... B65D 5/5038 206/139
9,868,578 B2 * 1/2018 Ridgeway ..... B65D 81/05
10,633,140 B1 * 4/2020 Vergara ..... B65D 5/4266
10,913,567 B2 * 2/2021 Nelson ..... B65D 5/002
10,947,007 B2 * 3/2021 Cline ..... B65D 5/5028
10,994,889 B1 * 5/2021 Rumsam ..... B65D 5/5028
11,059,645 B2 * 7/2021 Chambers ..... B65D 5/48014
11,518,605 B1 * 12/2022 Schnell ..... B65D 81/133
11,530,084 B1 * 12/2022 Brand ..... B65D 5/5035
12,065,294 B2 * 8/2024 Bandinu ..... B65D 5/5061
2003/0178338 A1 * 9/2003 Vore ..... B65D 5/5042 206/521
2004/0084349 A1 * 5/2004 Kari ..... B65D 5/5052 206/583
2006/0086635 A1 * 4/2006 Kari ..... B65D 5/5052 206/588
2006/0110573 A1 * 5/2006 Peng ..... B65D 81/05 428/121
2006/0131207 A1 * 6/2006 Kari ..... B65D 5/5045 206/591
2008/0128316 A1 * 6/2008 McDonald ..... B65D 81/022 53/472
2011/0240515 A1 * 10/2011 Ridgeway ..... B65D 5/5028 53/472
2012/0085678 A1 * 4/2012 Yoshida ..... B65D 5/509 206/592
2013/0008812 A1 * 1/2013 Swart ..... B65D 5/029 229/199
2014/0083894 A1 * 3/2014 Stopp ..... B65B 53/00 53/449
2016/0052691 A1 * 2/2016 Ridgeway ..... B65D 81/075 206/583
2016/0101923 A1 * 4/2016 Costanzo, Jr. ..... B65D 5/28 206/583
2016/0280416 A1 * 9/2016 Muise, Jr. ..... B65D 5/5028
2019/0031390 A1 * 1/2019 Hessburg ..... B65D 5/02
2019/0375567 A1 * 12/2019 Zelenak ..... B65D 5/36
2021/0122552 A1 * 4/2021 Campos ..... B65D 77/042
2021/0163202 A1 * 6/2021 Obeyesekere ..... B65D 81/022
2022/0081153 A1 * 3/2022 Fernandez ..... B65D 81/053
2025/0083888 A1 * 3/2025 McDonald ..... B65D 5/02
2025/0187784 A1 * 6/2025 Kadota ..... B65D 81/05
2025/0187809 A1 * 6/2025 Kitamoto ..... B65D 5/505
2025/0346388 A1 * 11/2025 Kitamoto ..... B65D 5/5042

* cited by examiner

PACKAGING SUPPORTER

CROSS-REFERENCE TO RELATED APPLICATIONS

This application is a national stage entry according to 35 U.S.C. 371 of PCT Application No. PCT/JP2023/008108 filed on Mar. 3, 2023, which claims priority to Japanese Patent Application No. 2022-047346, filed on Mar. 23, 2022.

TECHNICAL FIELD

The present disclosure relates to a packaging supporter to store and support an item to be packaged such as a photosensitive drum in a box made of, for example, corrugated cardboard.

BACKGROUND OF INVENTION

Known packaging supporters are described in, for example, Patent Literatures 1 and 2.

CITATION LIST

Patent Literature

Patent Literature 1: Japanese Unexamined Patent Application Publication No. 6-293362

Patent Literature 2: Japanese Unexamined Patent Application Publication No. 9-104476

SUMMARY

In an aspect of the present disclosure, a packaging supporter supports an item to be packaged in a box. The packaging supporter includes a support being a rectangular prism and being cushioning. The support includes first to seventh walls, and first and second reinforcements. The second wall includes a first fold and is continuous with the first wall with the first fold between the second wall and the first wall. The third wall includes a second fold and is continuous with the second wall with the second fold between the third wall and the second wall. The third wall faces the first wall and defines a first recessed corner between the second wall and the third wall. The fourth wall includes a third fold and is continuous with the third wall with the third fold between the fourth wall and the third wall. The fourth wall defines a third recessed corner between the third wall and the fourth wall. The fifth wall includes a fourth fold and is continuous with the fourth wall with the fourth fold between the fifth wall and the fourth wall. The fifth wall extends along the first wall. The sixth wall includes a fifth fold and is continuous with the fifth wall with the fifth fold between the sixth wall and the fifth wall. The sixth wall faces the second wall and the fourth wall and defines a second recessed corner between the fifth wall and the sixth wall. The seventh wall includes a sixth fold and is continuous with the sixth wall with the sixth fold between the seventh wall and the sixth wall. The seventh wall extends along the third wall. The first reinforcement is continuous with the first wall and protrudes from the first wall toward the third wall. The first reinforcement is supported by the first recessed corner. The second reinforcement is continuous with the seventh wall and protrudes from the seventh wall toward the fifth wall. The second reinforcement is supported by the second recessed corner.

DESCRIPTION OF EMBODIMENTS

Patent Literature 1 describes a cushioning body including a rectangular support tube that is formed by folding a sheet of corrugated cardboard. An adhesive plate inside the support tube has a leading edge folded at a fold line to form a bracing plate. The bracing plate has a leading edge in contact with an inner corner of the support tube to improve the strength of the support tube.

Patent Literature 2 describes a receiving cushioning material for packaging including a rectangular prism body that is formed by folding a sheet of corrugated cardboard. A middle reinforcement with a length equal to a diagonal line and two side reinforcements separately located on each side of the middle reinforcement are formed inside the rectangular prism body. The side reinforcements are folded along a diagonal line to intersect with the diagonal line of the middle reinforcement. A leading edge of each of the middle and side reinforcements comes in contact with a corner of a side wall to improve the shape retention, the cushioning ability, and the compression resistance of the receiving cushioning material.

The structure with a known technique described in Patent Literature 1 includes the single bracing plate extending along one diagonal line of the diagonal lines of a rectangular of the rectangular prism body, and may not reduce deformation under a pressing force applied obliquely from a direction not along the bracing plate. Additionally, the leading edge of the support tube is folded across its length to form the bracing plate. This is likely to increase the dimensions of the corrugated cardboard and the material cost. Further, the bracing plate is formed using the folded portion of the leading edge that is a part of the support tube. This thus restricts the direction and the arrangement of the bracing plate.

In the structure with a known technique described in Patent Literature 2, two side portions of the leading edge of the rectangular prism are folded inward to serve as the reinforcements and form bracing plates, and the middle portion of the leading edge is cut midway and folded inward to be orthogonal to the two side reinforcements as the middle reinforcement. This is likely to increase the dimensions of the corrugated cardboard and increase the manufacturing cost and the material cost as compared with a normal rectangular support tube.

A packaging supporter with high strength without upsizing the structure including known components is thus awaited.

A packaging supporter according to one or more embodiments of the present disclosure will be described below with reference to the drawings.

Figure 1:
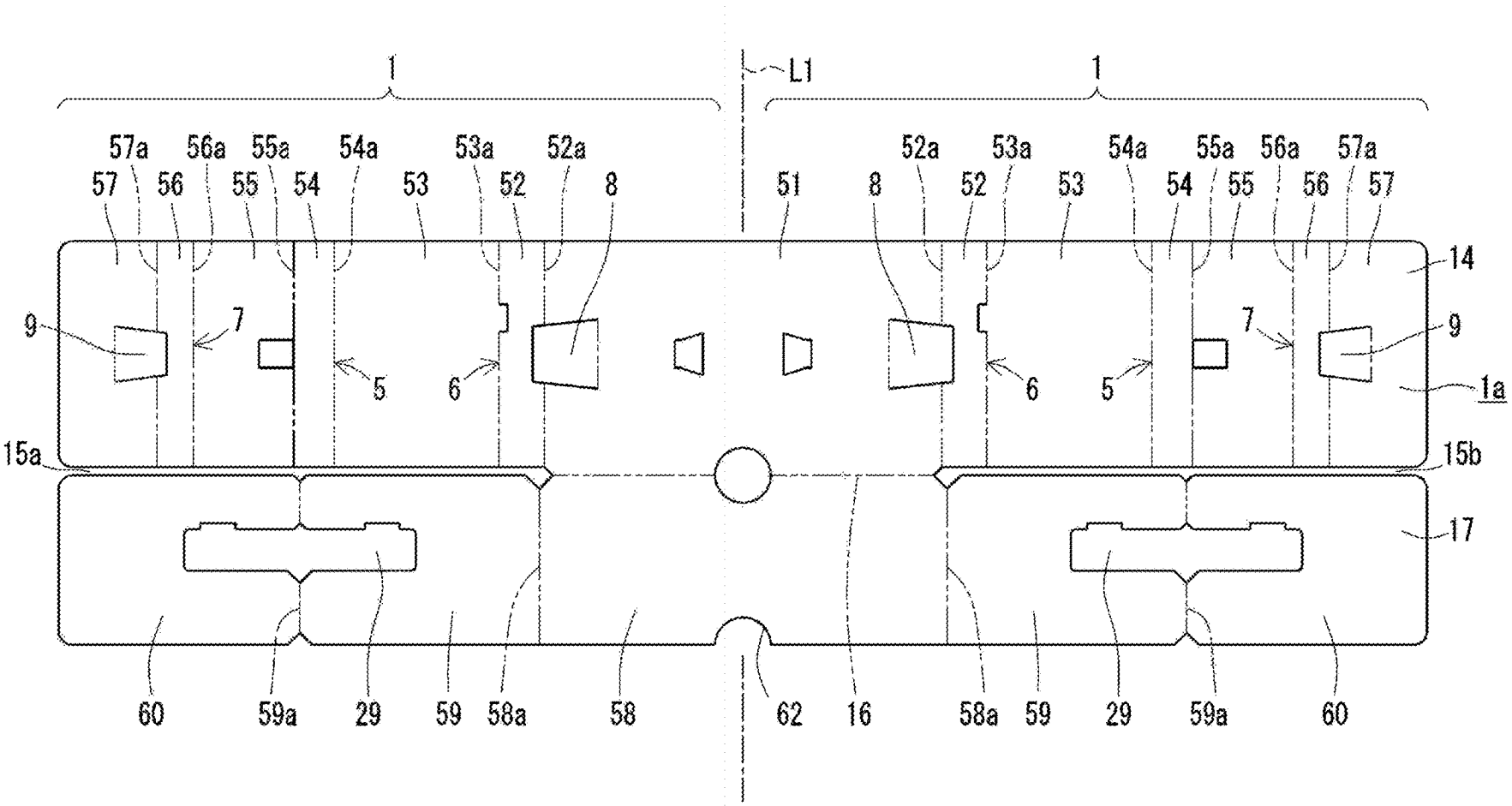
FIG. 1 is a development view of a packaging supporter according to an embodiment of the present disclosure.
Figure 2A:
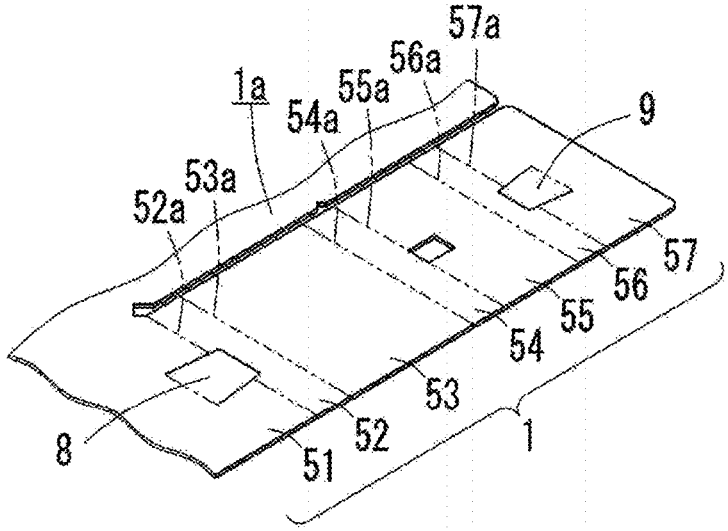
FIG. 2A is an enlarged perspective view of the packaging supporter, illustrating a portion adjacent to a support.
Figure 2B:
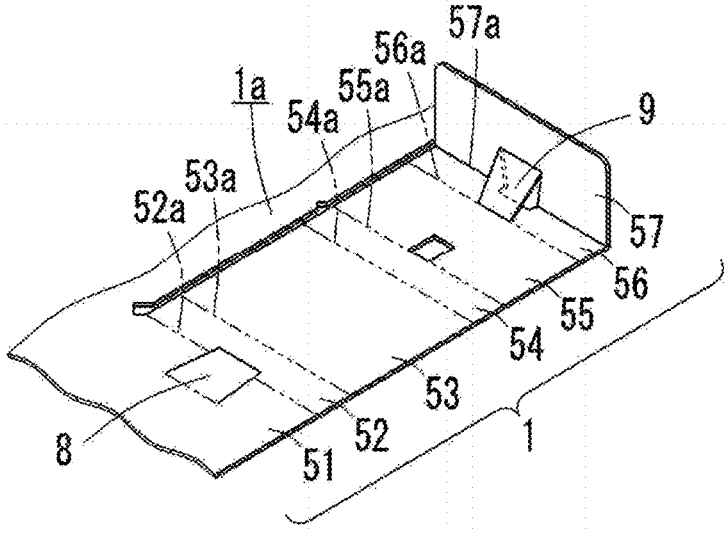
FIG. 2B is a perspective view of the packaging supporter with a seventh wall being upright.
Figure 2C:
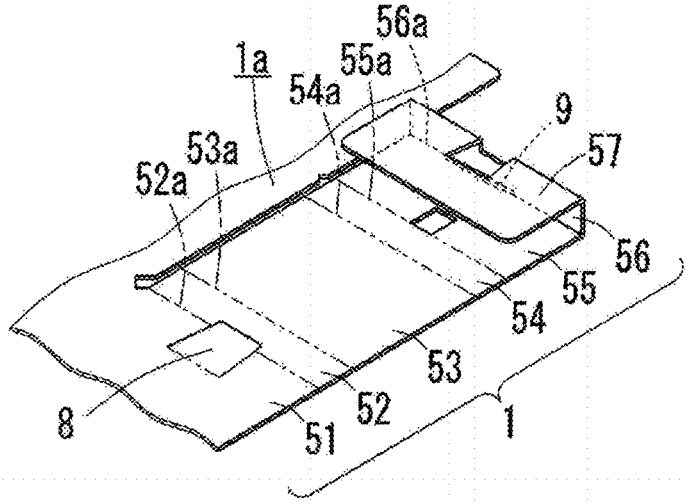
FIG. 2C is a perspective view of the packaging supporter with a sixth wall and the seventh wall both being upright.
Figure 2D:
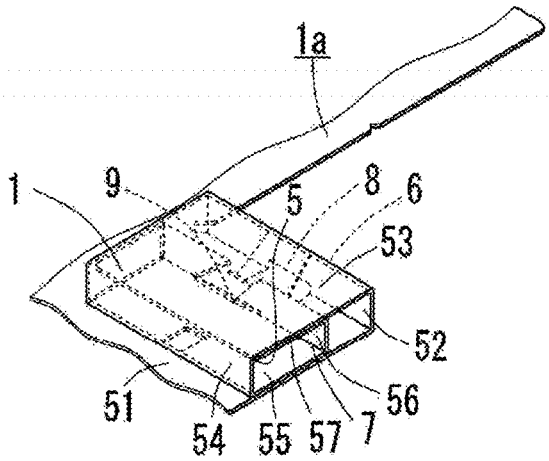
FIG. 2D is a perspective view of the packaging supporter with the support assembled.

FIG. 1 is a development view of a packaging supporter according to an embodiment of the present disclosure. FIG. 2A is an enlarged perspective view of the packaging supporter, illustrating a portion adjacent to a support. FIG. 2B is a perspective view of the packaging supporter with a seventh wall being upright. FIG. 2C is a perspective view of the packaging supporter with a sixth wall and the seventh wall both being upright. FIG. 2D is a perspective view of the packaging supporter with the support assembled. A packaging supporter 1 according to the present embodiment is, in a developed state as illustrated in FIG. 1, a substantially rectangular base board 1*a* that is a sheet of punched corrugated cardboard. When the corrugated cardboard is a wavy board with a paper liner attached to each of its two sides in a thickness direction of the corrugated cardboard, the wavy board is oriented to have its machine direction that is a direction of repeated recesses and protrusions of the wavy core board perpendicular to a longitudinal direction of the base board 1*a*. In the present embodiment, the packaging supporter 1 supports, in a box, a photosensitive drum with a large diameter as an example item to be packaged.

The packaging supporter 1 includes a pair of supports 4 that are rectangular prisms and serve as cushioning for supporting a photosensitive drum 3 in a box 2 illustrated in FIGS. 6 and 7 (described later). Each of the supports 4 includes a first reinforcement 8 and a second reinforcement 9. The box 2 is made of, for example, corrugated cardboard. The box 2 includes a body that is a rectangular prism, a bottom including four bottom boards each continuous with one of four sides of a first end of the body in its axial direction, and a lid including four upper boards each continuous with one of four sides of a second end of the body in its axial direction. The box 2 is a hollow rectangular prism with the bottom and the lid closed with respect to the body during packaging of the item.

The photosensitive drum 3 includes a drum body 3*a* that is a right cylinder. To support the photosensitive drum 3 in the box 2, in an example illustrated in FIGS. 6 and 7, the packaging supporter 1 including the supports 4 is used together with a pair of body receivers 11 that support the drum body 3*a*, a pair of insertion holders 12 that receive the body receivers 11, and a pair of covers 13 that cover, from above, the insertion holders 12 and two ends of the photosensitive drum 3 in its axial direction. Although these components are typically separate from one another, some of the components may be parts integrally included in the packaging supporter 1.

The base board 1*a* includes a first strip 14 and a second strip 17. The first strip 14 is symmetrical with respect to an imaginary plane including a central axis L1 passing through the center of the base board 1*a* in the longitudinal direction of the base board 1*a*, and includes, on each side across a single first wall 51, a second wall 52, a third wall 53, a fourth wall 54, a fifth wall 55, a sixth wall 56, and a seventh wall 57. The second to seventh walls 52 to 57 on one side and the second to seventh walls 52 to 57 on the other side are located symmetrically to each other in this order with respect to the first wall 51. The second strip 17 is continuous with the first wall 51 with an intermediate fold 16 defined by a pair of cutouts 15*a* and 15*b* between the second strip 17 and the first wall 51.

The example illustrated in FIG. 1 includes two portions to be the supports 4 that are located symmetrically to each other across the central axis L1. Each of the supports 4 includes the first wall 51, the second wall 52, the third wall 53, the fourth wall 54, the fifth wall 55, the sixth wall 56, and the seventh wall 57. The second wall 52 includes a first fold 52*a* and is continuous with the first wall 51 with the first fold 52*a* between them. The third wall 53 includes a second fold 53*a* and is continuous with the second wall 52 with the second fold 53*a* between them. The third wall 53 faces the first wall 51 and defines a first recessed corner 6 between the second wall 52 and the third wall 53. The fourth wall 54 includes a third fold 54*a* and is continuous with the third wall 53 with the third fold 54*a* between them. The fourth wall 54 defines a third recessed corner 5 between the third wall 53 and the fourth wall 54. The fifth wall 55 includes a fourth fold 55*a* and is continuous with the fourth wall 54 with the fourth fold 55*a* between them. The fifth wall 55 extends along the first wall 51. The sixth wall 56 includes a fifth fold 56*a* and is continuous with the fifth wall 55 with the fifth fold 56*a* between them. The sixth wall 56 faces the second wall 52 and the fourth wall 54, and defines a second recessed corner 7 between the fifth wall 55 and the sixth wall 56. The seventh wall 57 includes a sixth fold 57*a* and is continuous with the sixth wall 56 with the sixth fold 57*a* between them. The seventh wall 57 extends along the third wall 53.

The second strip 17 includes a single eighth wall 58, and a ninth wall 59 and a tenth wall 60 on each of both sides across the eighth wall 58. The eighth wall 58 includes the intermediate fold 16 and is continuous with the first wall 51 in the first strip 14 with the intermediate fold 16 between them. The intermediate fold 16 extends linearly between the cutouts 15*a* and 15*b*. The eighth wall 58 includes, on each of its two ends in its longitudinal direction, a seventh fold 58*a* perpendicular to the intermediate fold 16. The eighth wall 58 is continuous with the ninth wall 59 with the seventh fold 58*a* between them. The ninth wall 59 includes an eighth fold 59*a*. The ninth wall 59 is continuous with the tenth wall 60 with the eighth fold 59*a* between them. The eighth fold 59*a* is parallel to the seventh fold 58*a*. The ninth wall 59 has a cutout 29. The tenth wall 60 has the cutout 29. The cutouts 29 extend symmetrically to each other with respect to the eighth fold 59*a*. The ninth wall 59 and the tenth wall 60 on one side and the ninth wall 59 and the tenth wall 60 on the other side are located symmetrically to each other with respect to the imaginary plane including the central axis L1 described above.

The first wall 51 and the eighth wall 58 include a through-hole 61 that is circular in the developed state and has its center at the intersection of the intermediate fold 16 and the central axis L1. The eighth wall 58 includes, in a side portion opposite to a first side portion including the through-hole 61, a semicircular through-hole 62 having its center at the intersection of an outer periphery and the central axis L1.

The first reinforcement 8 is continuous with the first wall 51 and protrudes from the first wall 51 toward the third wall 53. When the support 4 is assembled, the first reinforcement 8 stands, along a fold, toward the inside of the support 4 to extend from the first wall 51 toward the second wall 52. A leading edge of the first reinforcement 8 then comes in contact with the first recessed corner 6 to support the first recessed corner 6. The second reinforcement 9 is continuous with the seventh wall 57 and protrudes from the seventh wall 57 toward the fifth wall 55. When the support 4 is assembled, the second reinforcement 9 stands, along a fold, toward the inside of the support 4 to extend from the seventh wall 57 toward the sixth wall 56. The second reinforcement 9 thus stands, inside the support 4, to be inclined in the opposite direction to the first reinforcement 8 across the sixth wall 56. A leading edge of the second reinforcement 9 then comes in contact with the second recessed corner 7 to support the second recessed corner 7. Each of the first reinforcement 8 and the second reinforcement 9 is trapezoidal in the developed state, with the lower side being longer than the upper side and continuous with the first wall 51 or the seventh wall 57. Thus, when a pressing force applied on the upper side reaches the lower side, the pressing force is distributed and transmitted to the first wall 51 and the seventh wall 57. This increases the strength of the first reinforcement 8 supporting the first recessed corner 6 and reduces the likelihood of the first reinforcement 8 braking or splitting at the lower side continuous with the first wall 51. In the same or in a similar manner, this increases the strength of the second reinforcement 9 supporting the second recessed corner 7 and reduces the likelihood of the second reinforcement 9 breaking or splitting at the lower side continuous with the seventh wall 57.

The packaging supporter 1 and the support 4 may be made of corrugated cardboard having a machine direction perpendicular to a direction in which the first to seventh walls 51 to 57 are continuous with one another.

Figure 3:
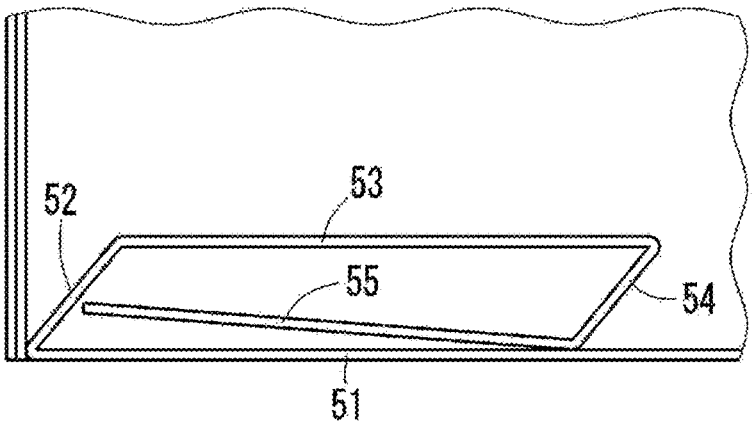
FIG. 3 is a side view of an assembly of a base board including first to fifth walls.
Figure 4:
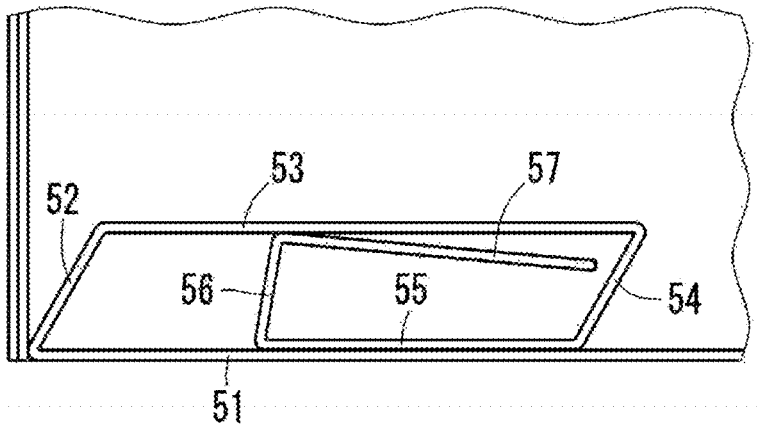
FIG. 4 is a side view of an assembly of a base board including first to seventh walls.
Figure 5:
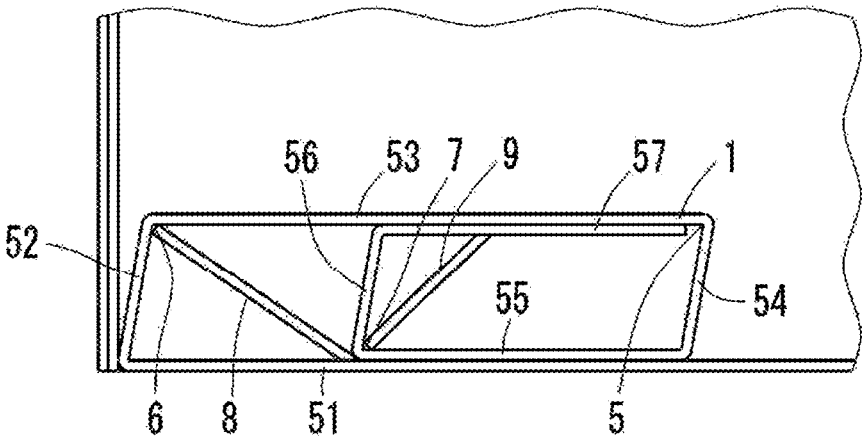
FIG. 5 is a side view of the support according to the embodiment of the present disclosure.

FIG. 3 is a side view of an assembly of a base board including the first to fifth walls 51 to 55. FIG. 4 is a side view of an assembly of a base board including the first to seventh walls 51 to 57. FIG. 5 is a side view of the support 4 in the embodiment of the present disclosure. For the base board including the first to fifth walls 51 to 55 folded into the assembly that is a rectangular prism with a cross section of a rectangle, an impact load from dropping of the box 2 storing the photosensitive drum 3 is applied on the long sides of the rectangle. This deforms the assembly receiving the load into a rhombus as illustrated in FIG. 3. The assembly may not have a sufficient strength. For the base board including the first to seventh walls 51 to 57 folded into the assembly that is a rectangular prism with a cross section of a rectangle, the impact load from the same or similar dropping is applied on the long sides of the rectangle. This deforms the assembly receiving the load into a rhombus as illustrated in FIG. 4. The assembly is deformed less than the structure in FIG. 3 but may not have a sufficient strength. In contrast, the support 4 in the present embodiment includes the first reinforcement 8 and the second reinforcement 9 to increase the durability against the impact load applied to the long sides of the rectangle. The support 4 is deformed less than the assembly of the base board including the first to seventh walls 51 to 57 in FIG. 4 and has a higher strength. The packaging supporter 1 including the support 4 thus has high strength for supporting the item and high impact durability.

Figure 6:
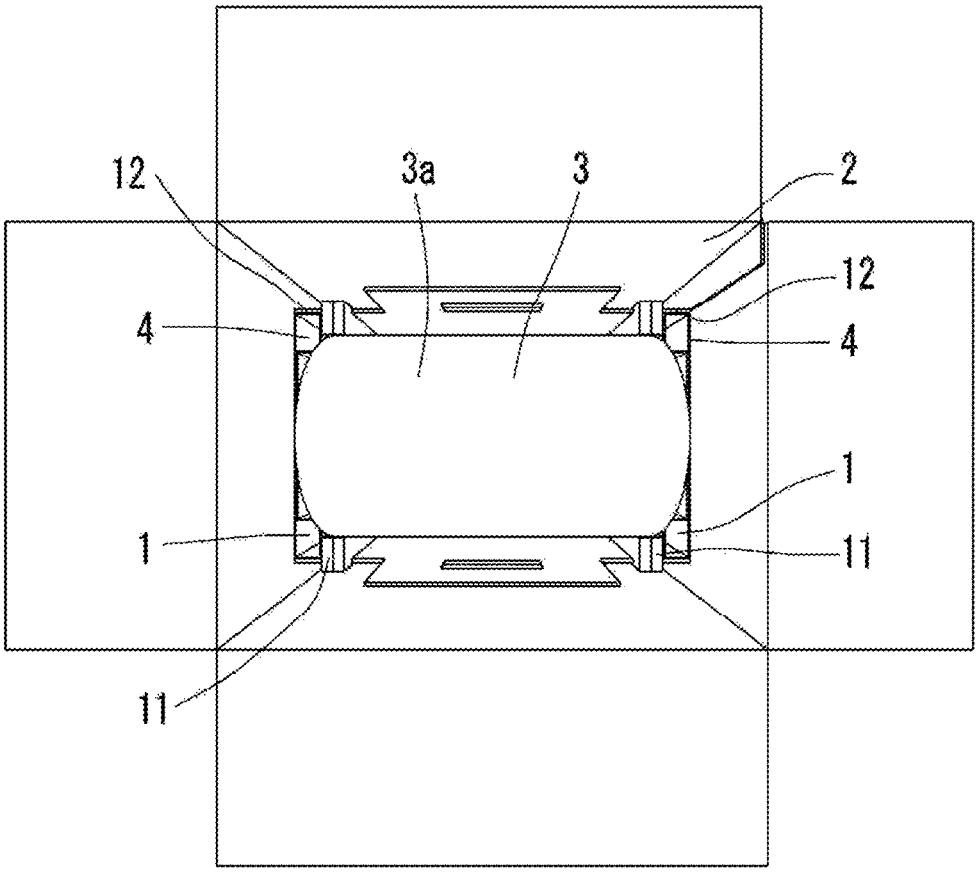
FIG. 6 is a plan view of a box storing a photosensitive drum together with the packaging supporters including the supports, body receivers, and insertion holders.

FIG. 6 is a plan view of the box 2 storing the photosensitive drum 3 together with the packaging supporters 1 including the supports 4, the body receivers 11, and the insertion holders 12. FIG. 7 is a plan view of the box 2 storing the photosensitive drum 3 together with the packaging supporters 1 including the supports 4 (hidden under the covers 13), the body receivers 11, and the insertion holders 12, with the covers 13 attached. As described above, the packaging supporter 1 according to the present embodiment includes the supports 4 each reinforced with the first reinforcement 8 and the second reinforcement 9. The supports 4, which also serve as cushioning, can thus endure the impact load on the photosensitive drum 3 from dropping of the box 2, reducing damage to the photosensitive drum 3 that is a packaged item.

Figure 8:
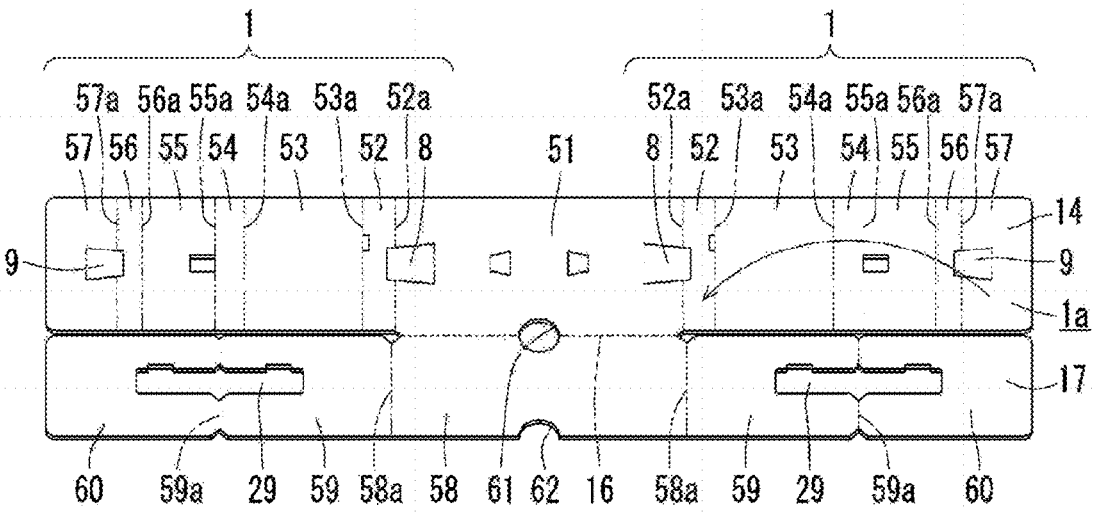
FIG. 8 is a diagram describing a procedure for assembling the packaging supporter.

FIGS. 8 to 12 are diagrams describing a procedure for assembling the packaging supporter 1. In assembling the packaging supporter 1, as illustrated in FIG. 8, a first support 4 on the right in the figure is assembled first to be a rectangular prism by sequentially folding a first end portion (right end portion) of the first strip 14 in the longitudinal direction inward at each of the folds 57*a*, 56*a*, 55*a*, 54*a*, 53*a*, and 52*a* for valley fold.

Figure 9:
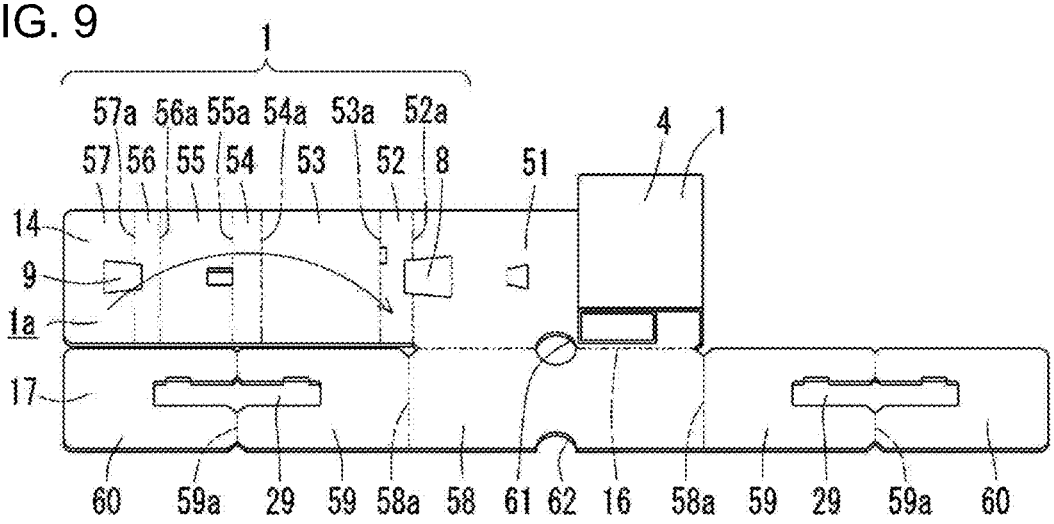
FIG. 9 is a diagram describing the procedure for assembling the packaging supporter.
Figure 10:
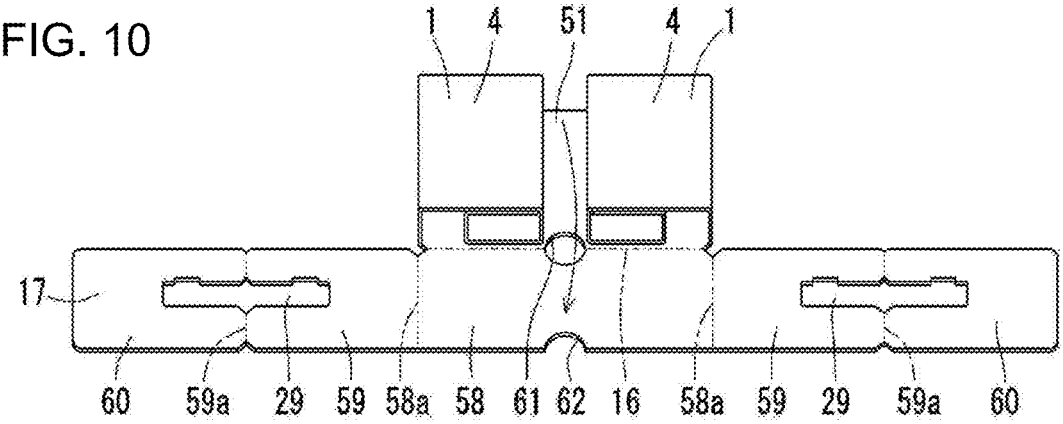
FIG. 10 is a diagram describing the procedure for assembling the packaging supporter.
Figure 11:
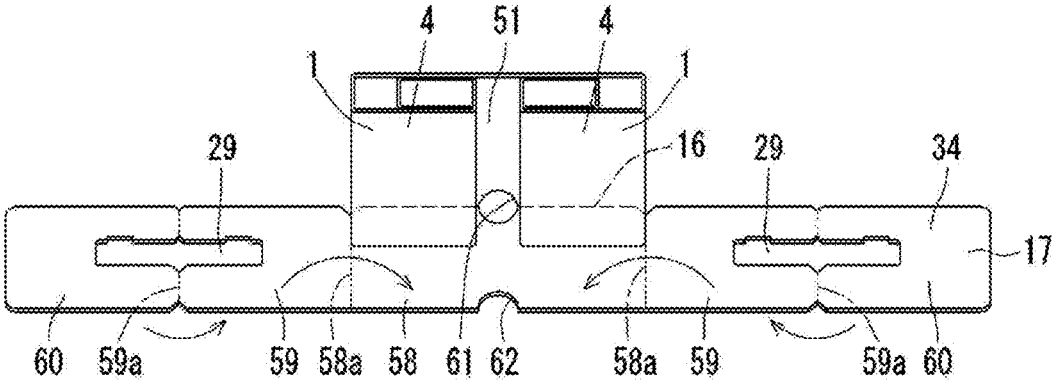
FIG. 11 is a diagram describing the procedure for assembling the packaging supporter.
Figure 12:
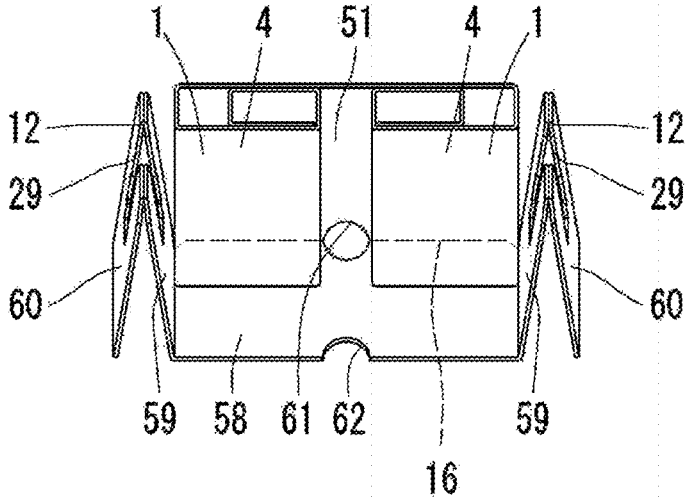
FIG. 12 is a diagram describing the procedure for assembling the packaging supporter.
Figure 13:
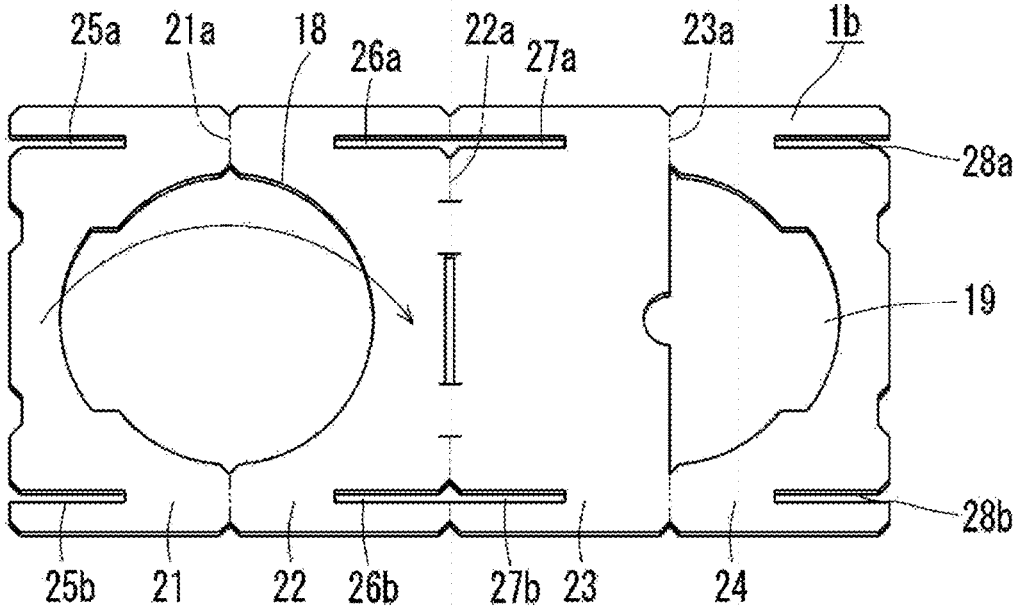
FIG. 13 is a diagram describing a procedure for assembling the body receiver.

Subsequently, as illustrated in FIG. 9, a second support 4 is assembled to be a rectangular prism by sequentially folding a second end portion (left end portion) of the first strip 14 in the longitudinal direction inward at each of the folds 57*a*, 56*a*, 55*a*, 54*a*, 53*a*, and 52*a* for valley fold. When the two supports 4 are assembled together, the first wall 51 is folded at about 90° to be upright on the second strip 17 together with the two supports 4 as illustrated in FIG. 10, and the second strip 17 is then folded inward from its two ends, with the eighth fold 59*a* mountain-folded and the seventh fold 58*a* valley-folded on each side as illustrated in FIG. 11. As illustrated in FIG. 12, the pair of insertion holders 12 folded into an inverted-V shape are thus assembled.

FIGS. 13 to 16 are diagrams describing a procedure for assembling the body receiver 11. The body receiver 11 is a substantially rectangular base board 1*b* made of corrugated cardboard. The body receiver 11 includes a through-hole 18 located on the left in FIG. 13 and having an inner diameter substantially the same as the outer diameter of the drum body 3*a* to allow the drum body 3*a* to be fitted in the through-hole 18. The body receiver 11 also includes a through-hole 19 located on the right with respect to the through-hole 18 in FIG. 13 and having a substantially semicircular shape that is symmetrical to the left half of the through-hole 18. The base board 1*b* is defined to include four sections referred to as, in this order from the left in the figure, a first portion 21, a second portion 22, a third portion 23, and a fourth portion 24, in the longitudinal direction of the base board 1*b*. The first portion 21 includes a first fold 21*a* at a position at which the first fold 21*a* divides the through-hole 18 equally between the first portion 21 and the second portion 22. The second portion 22 includes a second fold 22*a* between the second portion 22 and the third portion 23. The third portion 23 includes a third fold 23*a* between the third portion 23 and the fourth portion 24. The first portion 21, the second portion 22, the third portion 23, and the fourth portion 24 have the same width in a horizontal direction in FIG. 13.

Figure 14:
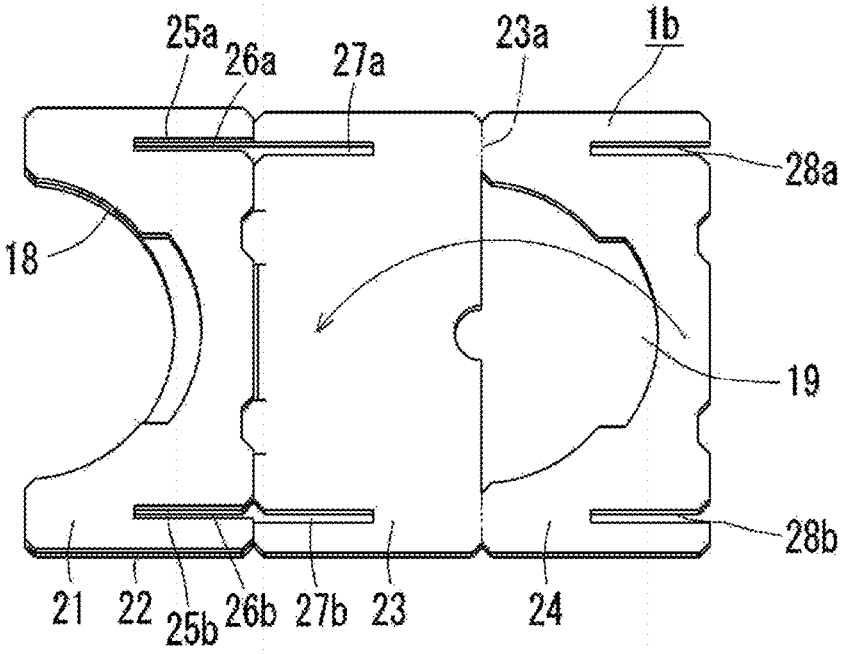
FIG. 14 is a diagram describing the procedure for assembling the body receiver.
Figure 15:
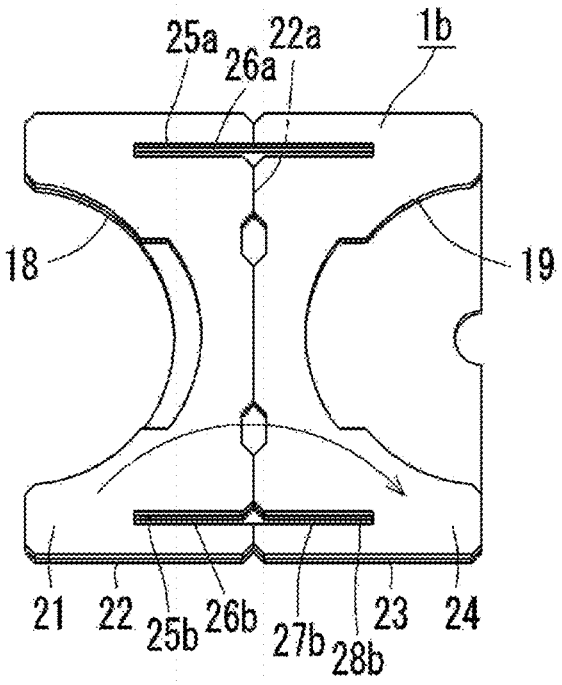
FIG. 15 is a diagram describing the procedure for assembling the body receiver.

When the first portion 21 is folded inward at the first fold 21*a* for valley fold to overlap the second portion 22, a half of the through-hole 18 overlaps the other half of the through-hole 18 to have a semicircular shape as illustrated in FIG. 14. Then, when the fourth portion 24 is folded inward at the third fold 23*a* for valley fold to overlap the third portion 23, a part of the third portion 23 located below is partially exposed through the semicircular through-hole 19 in the fourth portion 24 as illustrated in FIG. 15. The first to fourth portions 21 to 24 include the respective cutouts 25*a* and 25*b*, 26*a* and 26*b*, 27*a* and 27*b*, and 28*a* and 28*b* at positions adjacent to the two ends of the respective first to fourth portions 21 to 24 in a width direction perpendicular to the longitudinal direction of the base board 1*b*.

Figure 16:
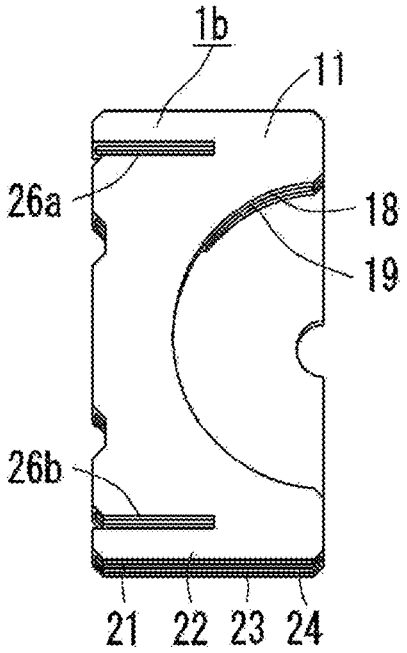
FIG. 16 is a diagram describing the procedure for assembling the body receiver.

Subsequently, when the first portion 21 and the second portion 22 are folded inward at the second fold 22*a* for valley fold to overlap the fourth portion 24, the body receiver 11 including the through-holes 18 and 19 that are semicircular and overlap each other is formed as illustrated in FIG. 16. To support the two ends of the drum body 3*a* with the first portion 21, the second portion 22, and a part of the fourth portion 24 exposed through each of the through-holes 18 and 19, two body receivers 11 with the above structure are used when the single photosensitive drum 3 is packaged in the single box 2.

Figure 17:
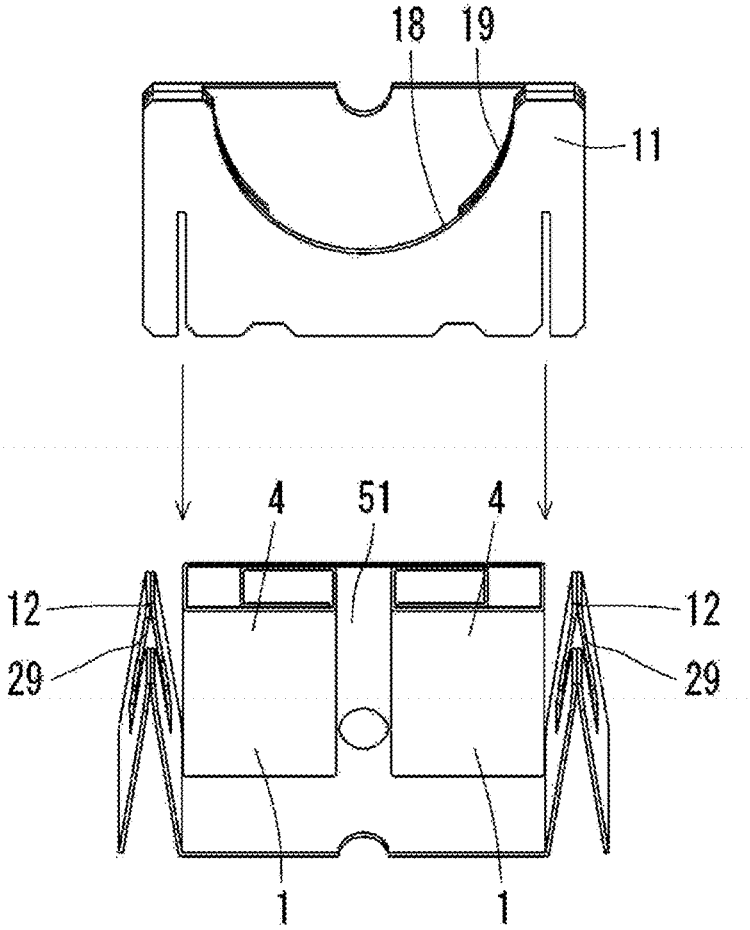
FIG. 17 is a diagram describing a procedure for attaching the body receiver to the insertion holders.
Figure 18:
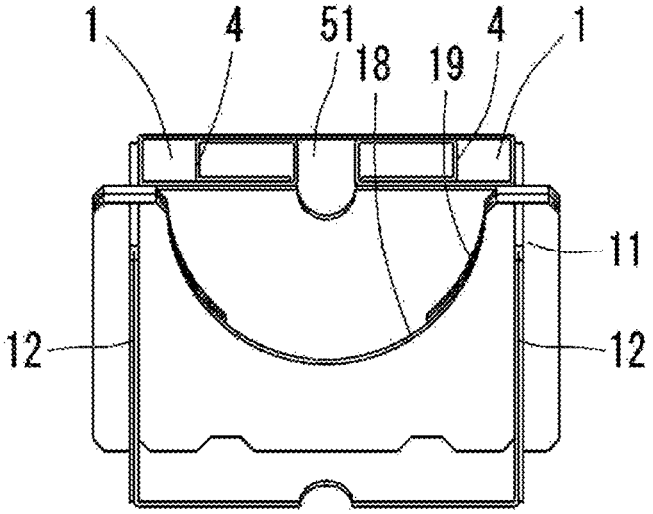
FIG. 18 is a diagram of the body receiver held by the insertion holders.

FIG. 17 is a diagram describing a procedure for attaching the body receiver 11 to the insertion holders 12. FIG. 18 is a diagram of the body receiver 11 held by the insertion holders 12. With the first to fourth portions 21 to 24 overlapping one another as illustrated in FIG. 16, the cutouts 25*a* to 28*a* and the cutouts 25*b* to 28*b* in the body receiver 11 also overlap one another and are open in a first direction (leftward in FIG. 16). The body receiver 11 is inserted into the insertion holders 12 through the cutout 29 of each of the insertion holders 12 to cause the cutouts 25*a* to 28*a* and 25*b* to 28*b* to be meshed with the corresponding cutout 29. This reduces displacement of the body receiver 11 and stably holds the body receiver 11 at a predetermined position with respect to the insertion holders 12 in the packaging supporter 1. This combination of components stably support the photosensitive drum 3 in the box 2.

Figure 7:
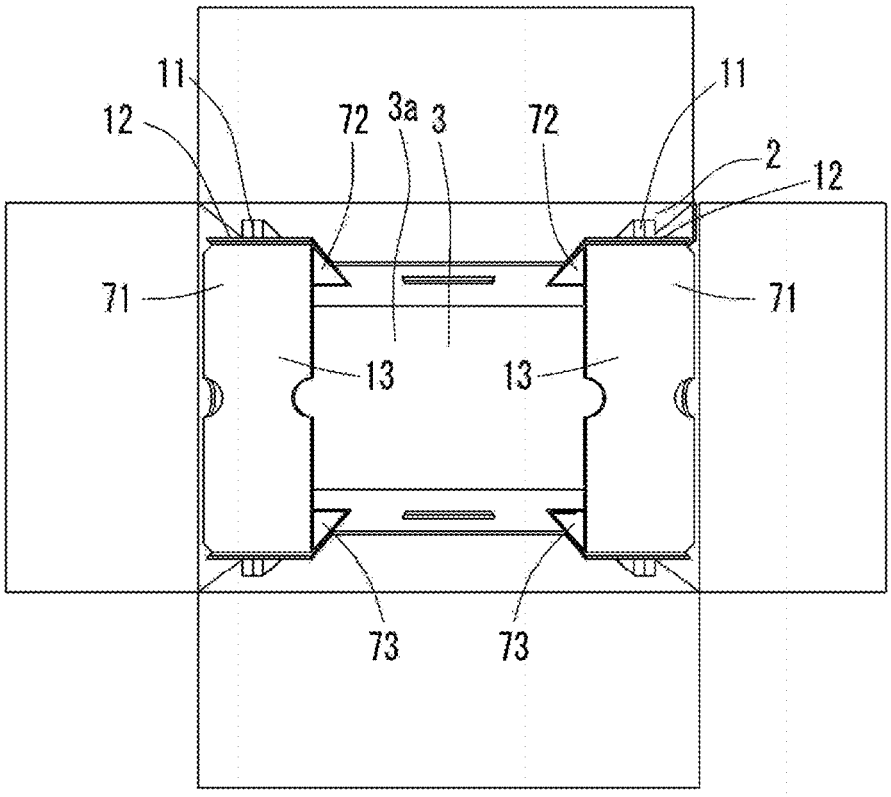
FIG. 7 is a plan view of the box storing the photosensitive drum together with the packaging supporters including the supports, the body receivers, and the insertion holders, with covers attached.

As illustrated in FIG. 7 described above, the covers 13 each include a ceiling plate 71 that is substantially rectangular as viewed in plan to cover, from above, the two ends of the photosensitive drum 3 in the axial direction, and a pair of side plates 72 and 73 that are folded at substantially right angles to be continuous with the respective ends of the ceiling plate 71 in the longitudinal direction of the ceiling plate 71. Each of the side plates 72 and 73 includes a cutout in which the body receiver 11 is fitted. The body receiver 11 fitted in each of the cutout in the side plates 72 and 73 reduces the displacement of the covers 13 with respect to the body receiver 11, allowing the two ends of the photosensitive drum 3 in the axial direction to be covered with the ceiling plates 71 and reducing damage to the photosensitive drum 3 caused by vibrations or other factors in the box 2.

In the above embodiment, the single support 4 includes the single first reinforcement 8 and the single second reinforcement 9. In another embodiment of the present disclosure, however, the single support 4 may include multiple (e.g., two or more) first reinforcements 8 and second reinforcements 9 in the width direction. This further increases the compression strength and allows the packaging supporter to have higher durability against the impact load.

The multiple first reinforcements 8 and the multiple second reinforcements 9 may be arranged to have multiple pairs of the first reinforcement 8 and the second reinforcement 9 facing each other, or to alternate the first reinforcements 8 and the second reinforcements 9. The multiple pairs of the first reinforcement 8 and the second reinforcement 9 may each have any width and may be arranged at any intervals between the pairs. The widths and the intervals may be set as appropriate for the packaging specifications. The first reinforcements 8 and the second reinforcements 9 arranged alternately may each have any width and may be arranged at any intervals between them. The widths and the intervals may be set as appropriate for the packaging specifications. For example, as appropriate for the packaging specifications, one second reinforcement 9 may be located between two first reinforcements 8, one first reinforcement 8 may be located between two second reinforcements 9, the same numbers of first reinforcements 8 and second reinforcements 9 may be located alternately one by one, or the multiple first reinforcements 8 and the multiple second reinforcements 9 may be located alternately. In either case, the widths of the reinforcements and the intervals between them may be set as appropriate. When the first reinforcement 8 and the second reinforcement 9 are trapezoidal, the oblique sides of the first reinforcement 8 and the second reinforcement 9 may each have any angles, and may be set as appropriate for the packaging specifications. For example, the oblique sides may all have the same angle, or may have different angles appropriate for the positions.

In still another embodiment of the present disclosure, the packaging supporter may be made of, instead of the corrugated cardboard described above, a material with appropriate elasticity and flexibility such as general-purpose plastic including soft polyvinyl chloride, polyethylene, and polypropylene, or a sheet made of foamed plastic or processed paper.

In the present embodiment, as described above, the first reinforcement 8 is formed in areas in the first wall 51 and the second wall 52, and the second reinforcement 9 is formed in areas in the sixth wall 56 and the seventh wall 57. The first reinforcement 8 and the second reinforcement 9 can thus be formed without increasing the use of materials such as corrugated cardboard, and can improve the load strength without bonding. This increases the durability of the support 4 against the impact load, allowing the packaging supporter 1 to have high strength against the impact load without upsizing the structure of the packaging supporter 1. The packaging supporter 1 can thus reduce damage to the item and protect the item with larger dimensions and higher mass, as with a photosensitive drum having a large diameter, and receives a large external force such as a shock load from falling or collapsing during transportation. The packaging supporter 1 can also be used to support many relatively small items such as photosensitive drums with small diameters that are to be packaged collectively. The item as an example in the present embodiment is a photosensitive drum. However, the item may be any object to be packaged such as various industrial or consumer devices, or various mechanical or electronic components.

The packaging supporter according to one or more embodiments of the present disclosure includes the support with high strength without upsizing the structure.

The packaging supporter according to one or more embodiments of the present disclosure may have may have aspects (1) to (6) described below.

(1) A packaging supporter for supporting an item to be packaged in a box, the packaging supporter comprising:

a support being a rectangular prism and being cushioning, wherein the support includes a first wall, a second wall including a first fold and being continuous with the first wall with the first fold between the second wall and the first wall, a third wall including a second fold and being continuous with the second wall with the second fold between the third wall and the second wall, the third wall facing the first wall and defining a first recessed corner between the second wall and the third wall, a fourth wall including a third fold and being continuous with the third wall with the third fold between the fourth wall and the third wall, the fourth wall defining a third recessed corner between the third wall and the fourth wall, a fifth wall including a fourth fold and being continuous with the fourth wall with the fourth fold between the fifth wall and the fourth wall, the fifth wall extending along the first wall, a sixth wall including a fifth fold and being continuous with the fifth wall with the fifth fold between the sixth wall and the fifth wall, the sixth wall facing the second wall and the fourth wall and defining a second recessed corner between the fifth wall and the sixth wall, a seventh wall including a sixth fold and being continuous with the sixth wall with the sixth fold between the seventh wall and the sixth wall, the seventh wall extending along the third wall, a first reinforcement being continuous with the first wall and protruding from the first wall toward the third wall, the first reinforcement being supported by the first recessed corner, and a second reinforcement being continuous with the seventh wall and protruding from the seventh wall toward the fifth wall, the second reinforcement being supported by the second recessed corner.

(2) The packaging supporter according to (1), wherein the seventh wall is supported by the third recessed corner.

(3) The packaging supporter according to (1) or (2), wherein the first reinforcement is trapezoidal in a developed state.

(4) The packaging supporter according to any one of (1) to (3), wherein the second reinforcement is trapezoidal in a developed state.

(5) The packaging supporter according to any one of (1) to (4), wherein the support further includes one or more first reinforcements or one or more second reinforcements located in an axial direction of the support, or the support further includes one or more first reinforcements and one or more second reinforcements located in the axial direction of the support.

(6) The packaging supporter according to any one of (1) to (5), wherein the packaging supporter comprises corrugated cardboard having a machine direction perpendicular to a direction in which the first wall to the seventh wall are continuous with one another.

Although embodiments of the present disclosure have been described in detail, the present disclosure is not limited to the embodiments, and may be changed or varied in various manners without departing from the spirit and scope of the present disclosure. The components described in the above embodiments may be entirely or partially combined as appropriate unless any contradiction arises.

REFERENCE SIGNS

1 packaging supporter
1*a*, 1*b* base board
2 box
3 photosensitive drum (item)
4 support
5 third recessed corner
6 first recessed corner
7 second recessed corner
8 first reinforcement
9 second reinforcement
18, 19 through-hole
21 first portion
22 second portion
23 third portion
24 fourth portion
51 first wall
52 second wall
52*a* first fold
53 third wall
53*a* second fold
54 fourth wall
54*a* third fold
55 fifth wall
55*a* fourth fold
56 sixth wall
56*a* fifth fold
57 seventh wall
57*a* sixth fold
58 eighth wall
58*a* seventh fold
59 ninth wall
59*a* eighth fold
60 tenth wall

The invention claimed is:

1. A packaging supporter for supporting an item to be packaged in a box, the packaging supporter comprising:

a support being a rectangular prism and being cushioning, wherein the support includes a first wall, a second wall including a first fold and being continuous with the first wall with the first fold between the second wall and the first wall, a third wall including a second fold and being continuous with the second wall with the second fold between the third wall and the second wall, the third wall facing the first wall and defining a first recessed corner between the second wall and the third wall, a fourth wall including a third fold and being continuous with the third wall with the third fold between the fourth wall and the third wall, the fourth wall defining a third recessed corner between the third wall and the fourth wall, a fifth wall including a fourth fold and being continuous with the fourth wall with the fourth fold between the fifth wall and the fourth wall, the fifth wall being located between the first wall and the third wall, a sixth wall including a fifth fold and being continuous with the fifth wall with the fifth fold between the sixth wall and the fifth wall, the sixth wall facing the second wall and the fourth wall and defining a second recessed corner between the fifth wall and the sixth wall, a seventh wall including a sixth fold and being continuous with the sixth wall with the sixth fold between the seventh wall and the sixth wall, the seventh wall being located between the third wall and the fifth wall, a first reinforcement being continuous with the first wall and protruding from the first wall toward the third wall, the first reinforcement being in contact with the first recessed corner, and a second reinforcement being continuous with the seventh wall and protruding from the seventh wall toward the fifth wall, the second reinforcement being in contact with the second recessed corner.

2. The packaging supporter according to claim 1, wherein the seventh wall is supported by the third recessed corner.

3. The packaging supporter according to claim 1, wherein the first reinforcement is trapezoidal in a developed state.

4. The packaging supporter according to claim 1, wherein the second reinforcement is trapezoidal in a developed state.

5. The packaging supporter according to claim 1, wherein the support further includes one or more first reinforcements or one or more second reinforcements located in an axial direction of the support, or the support further includes one or more first reinforcements and one or more second reinforcements located in the axial direction of the support.

6. The packaging supporter according to claim 1, wherein the packaging supporter comprises, in a developed state, a corrugated cardboard having a machine direction perpendicular to a direction in which the first wall to the seventh wall are continuous with one another.

7. The packaging supporter according to claim 1, wherein the support further includes one or more first reinforcements or one or more second reinforcements located in a width direction of the support, the width direction being perpendicular to a direction in which the first wall to the seventh wall are continuous with one another.

8. The packaging supporter according to claim 1, wherein the support further includes one or more first reinforcements and one or more second reinforcements located in a width direction of the support, the width direction being perpendicular to a direction in which the first wall to the seventh wall are continuous with one another.

* * * * *